US007886386B2

(12) United States Patent
Balonick et al.

(10) Patent No.: US 7,886,386 B2
(45) Date of Patent: Feb. 15, 2011

(54) MATTRESS

(75) Inventors: Arnold Balonick, Encino, CA (US); Curtis Wyatt, Corona, CA (US)

(73) Assignee: BG Industries, LLC., Northridge, CA (US)

( * ) Notice: Subject to any disclaimer, the term of this patent is extended or adjusted under 35 U.S.C. 154(b) by 684 days.

(21) Appl. No.: 11/909,783

(22) PCT Filed: Mar. 28, 2006

(86) PCT No.: PCT/US2006/011424

§ 371 (c)(1),
(2), (4) Date: Sep. 26, 2007

(87) PCT Pub. No.: WO2006/105169

PCT Pub. Date: Oct. 5, 2006

(65) Prior Publication Data

US 2010/0180384 A1 Jul. 22, 2010

Related U.S. Application Data

(60) Provisional application No. 60/665,982, filed on Mar. 28, 2005.

(51) Int. Cl.
*A47C 27/18* (2006.01)
*A47C 27/10* (2006.01)
*A61G 7/057* (2006.01)

(52) U.S. Cl. ..... 5/709; 5/713; 5/710; 5/734

(58) Field of Classification Search ..... 5/709, 5/710, 713, 718, 722, 734, 738–740
See application file for complete search history.

(56) References Cited

U.S. PATENT DOCUMENTS 3,653,083 A * 4/1972 Lapidus ..... 5/713

(Continued)

FOREIGN PATENT DOCUMENTS

EP 0 878 150 A2 11/1998

(Continued)

OTHER PUBLICATIONS

Chinese Office Action in counterpart application CN 200680008736.7, dated Sep. 25, 2009.

(Continued)

*Primary Examiner*—Robert G Santos
(74) *Attorney, Agent, or Firm*—Chen Yoshimura LLP

(57) ABSTRACT

Air mattresses primarily intended for hospitals, long-term care facilities and in-home use are described. The mattress includes multiple foam layers and an air sector having multiple resilient foam filled air cylinders. The air cylinders at different locations are filled with foam having different density (firmness); some are filled with multiple layers of foam. Each air cylinder has an air inlet connected to the atmosphere by an inlet valve and an air outlet. The air outlets are either connected to one or more restricted internal check outlet valves in a non-powered air mattress, or connected to a pump via hose connectors in a powered air mattress. The restricted outflow of air from the cylinders in a non-powered air mattress allows the patient to slowly settle into the supportive foam layers for optimal interface pressure distribution. The air cylinders re-inflate when the patient adjusts position or is vacated from the surface.

6 Claims, 8 Drawing Sheets

U.S. PATENT DOCUMENTS

| | | | | |
|---|---|---|---|---|
| 5,398,354 | A * | 3/1995 | Balonick et al. | 5/728 |
| 5,634,224 | A * | 6/1997 | Gates | 5/709 |
| 6,269,505 | B1 * | 8/2001 | Wilkinson | 5/713 |
| 6,370,716 | B1 * | 4/2002 | Wilkinson | 5/715 |
| 6,564,411 | B2 | 5/2003 | Pirzada | |
| 6,694,556 | B2 | 2/2004 | Stolpmann | |
| 6,813,790 | B2 | 11/2004 | Flick et al. | |
| 6,826,795 | B2 * | 12/2004 | Wilkinson | 5/713 |
| 6,922,863 | B2 | 8/2005 | Giori et al. | |
| 2002/0129448 | A1 | 9/2002 | Pirzada | |
| 2002/0148046 | A1 | 10/2002 | Pirzada | |
| 2003/0024051 | A2 * | 2/2003 | Wilkinson | 5/713 |
| 2005/0060808 | A1 | 3/2005 | Shaw | |
| 2007/0186349 | A1 * | 8/2007 | Lipman et al. | 5/713 |
| 2010/0180384 | A1 * | 7/2010 | Balonick et al. | 5/709 |

FOREIGN PATENT DOCUMENTS

| | | | |
|---|---|---|---|
| EP | 1 121 881 | A1 | 8/2001 |

OTHER PUBLICATIONS

European Search Report in counterpart application EP 06 73 9901, dated Feb. 18, 2009.
New Zealand Examination Report in the counterpart application, NZ 562851, dated Jul. 27, 2009.
International Search Report and Written Opinion by the ISA in PCT/US06/11424, Oct. 4, 2006.

* cited by examiner

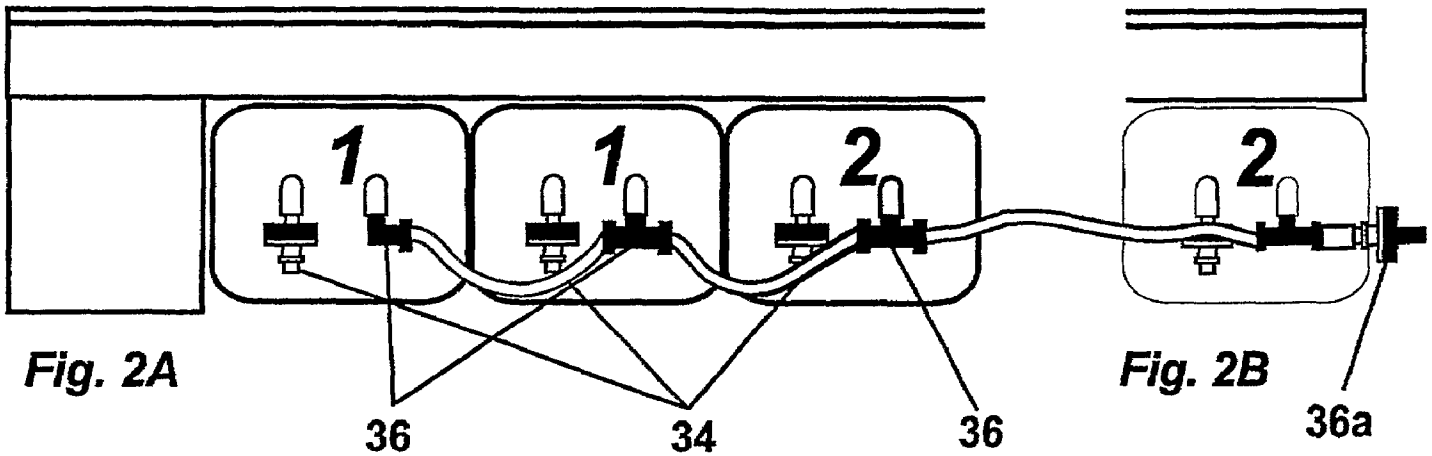
Fig. 2B
Fig. 2A
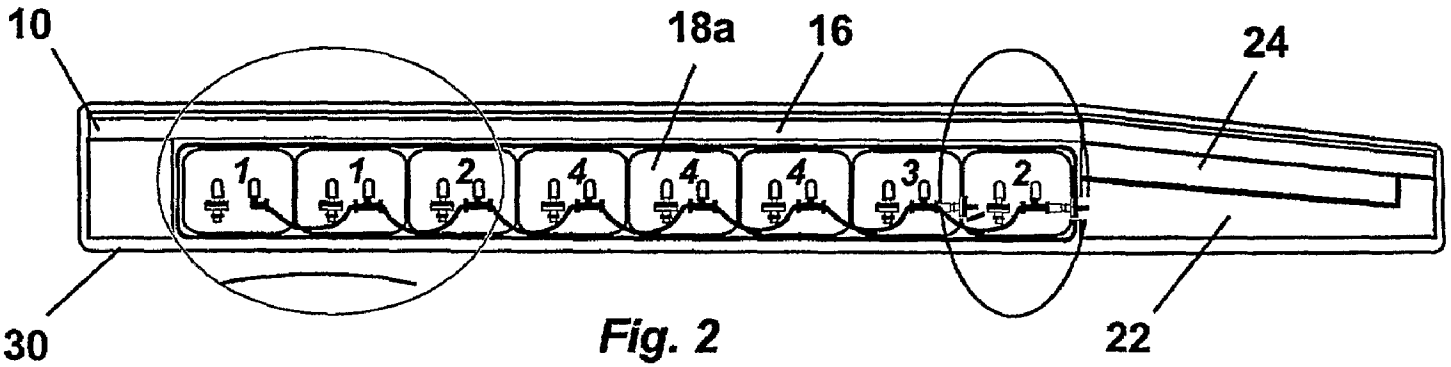
Fig. 2

MATTRESS

The present application is a continuation-in-part of U.S. Provisional application No. 60/665,982, filed Mar. 28, 2005, which is incorporated by reference herein.

BACKGROUND OF THE INVENTION

1. Field of the Invention

The present invention relates to powered and non-powered air mattresses primarily intended for hospitals, long-term care facilities and in-home use. Such air mattresses are designed to prevent or limit the creation of ulcers on the body of the patient during long periods of lying on the mattress.

2. Description of the Related Art

There have been air mattresses made for use in long-term care facilities and hospitals having air cylinders. U.S. Pat. No. 5,634,224 to Gates describes a cushioning device comprising an envelope containing a fluid in which the envelope has a pressure relief valve and an intake valve to regulate the deformation of the envelope under the load and reformation of the envelope when the load is removed. U.S. Pat. No. 6,223,369 to Maier describes patient support surfaces that use different arrangements of air cylinders and static or dynamic performance thereof, either non-powered or powered. At external valving arrangement for a static non-powered embodiment permits practice of a "recharging" technique using an air pump and self-calibrated valve, to return the air pressure in static air cylinders to their original manufactured specifications.

SUMMARY OF THE INVENTION

The present invention is directed to an improved mattress that substantially obviates one or more of the problems due to limitations and disadvantages of the related art.

It is an object of the present invention to provide an air mattress that has an improved foam arrangement for supporting the patient.

It is another object to provide an air mattress that will assist in preventing or limiting ulcers.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides an air mattress, including: a plurality of layers of foam, and a plurality of air cylinders, at least some of the air cylinders being filled with different density resilient foam. Preferably, at least some of the air cylinders are each filled with two or more layers of different density resilient foam. Further, each air cylinder includes an air inlet connected to the atmosphere by an air inlet valve and an air outlet. The air outlets of all air cylinders may be connected together and to a restricted internal check outlet valve. Alternatively, the air outlets of alternating air cylinders may be connected together and to a restricted internal check outlet valve. Alternatively, the air outlets of alternating air cylinders may be connected together and to a hose connector which is adapted for connecting to a pump.

It is to be understood that both the foregoing general description and the following detailed description are exemplary and explanatory and are intended to provide further explanation of the invention as claimed.

BRIEF DESCRIPTION OF THE DRAWINGS

FIG. 2 is a side sectional view of an air mattress according to an embodiment of the present invention.

FIGS. 2A and 2B are enlarged views showing the air inlet/outlet connections of the air mattress shown in FIG. 2.

DETAILED DESCRIPTION OF THE PREFERRED EMBODIMENTS

The present invention is directed to improved air mattresses primarily intended for hospitals, long term care facilities and in-home use. An air mattress according to embodiments of the invention has an improved construction of layered foam to further limit or prevent ulcerations from the patient lying on the mattress for long periods. Foam layers having various densities and firmnesses are used to provide specific support characteristics. The various support characteristics are achieved by layering various densities of foam. The selection of the foam densities is such that the pressures of the body in various portions of the mattress are optimized. For example, the pressure at the heel portions of the body, the pressure at the head portion of the body and the pressure at the thigh portions of the body are all and foam pieces are selected to optimize the reduction of the occurrence of ulcers.

Examples of air mattresses according to an embodiment of the present invention are described. Details are given for the materials used in their construction and shapes and dimensions of the various components; but it should be understood that these materials, shapes and dimensions are preferred embodiments only and the invention is not limited to the particular materials, shapes and dimensions.

Figure 1:
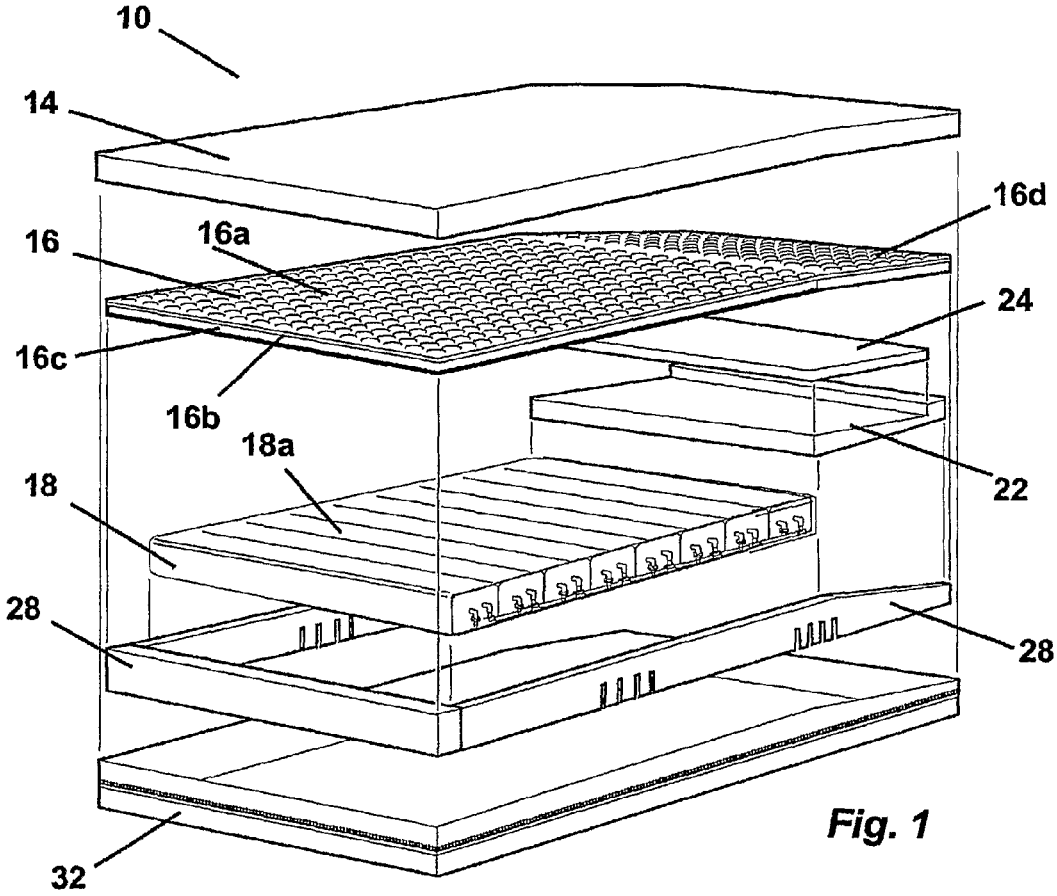
FIG. 1 is an exploded view of an air mattress according to an embodiment of the present invention.

FIG. 1 is an exploded view of an air mattress 10 according to an embodiment of the present invention. While the embodiment shown is for a non-powered air mattress, a powered air mattress which uses a motor can also be constructed using the same configuration of foam layers.

As shown in FIG. 1, a top cover 14 of the mattress 10 is made of Elastimax S™. The top cover 14 is air permeable so as to prevent "sweating" and moisture accumulation on the mattress. A first foam layer 16 has two segments. The head end and body portion 16*a* consists of two layers of foam, the upper layer 16*b* being 15 IFD 1.45 lb/ft$^3$ foam and the lower layer 16*c* being 25 IFD 1.85 lb/ft$^3$ foam. The foot portion 16*d* is a single layer of 15 IFD 1.45 lb/ft$^3$ foam. As shown more clearly in FIG. 2, the foot portion 16*d* is slightly sloped downwardly from the head end to the foot end.

Below the first foam layer 16 is an air sector 18 including eight air cylinders 18*a* filled with resilient foam materials. The foam filling of each of these cylinders is shown in FIGS. 4A-D and will be described in more detail later. Each of the eight cylinders 18*a* is surrounded by a fabric sleeve of flexible material, such as polyurethane or nylon, and each sleeve is connected to the adjacent sleeve(s). At the end of the foam filled air cylinders there is a foot segment including a heel support 22 made of 31 IFD 1.80 lb/ft$^3$ foam. Resting on top of the heel support 22 and beneath the sloped segment of the foot portion 16*d* of the first foam layer is a fiber filled heel pillow 24. A raised end segment of the heel support 22 holds the heel pillow 24 in place between the raised end and the far right end of the cylinders 18*a*. One example of a fiber filled heel pillow that can be used as the heel pillow 24 is described in commonly owned U.S. Pat. No. 5,398,354, the disclosure of which is incorporated herein by reference. The heel support 22 and heel pillow 24 form a heel support assembly 26. A U shaped side/end rail 28 made of 55 IFD 1.80 lb/ft$^3$ foam surrounds the cylinders 18*a* and the heel support assembly 26 and holds them in place.

As shown in FIG. 2, a flexible skin cover 30 encloses the first foam layer 16, the air sector 18, the heel support assembly 26 and the side/end rail 28. (The flexible skin cover 30 is not shown in FIG. 1 to avoid overcrowding.) There are a number of conventional ways of making the skin cover 30, such as using a sleeve or heat sealing the skin around the cylinders. The flexible skin cover 30 is waterproof and protects the foam components from contamination.

Figures 7, 7A, 8, 8A:
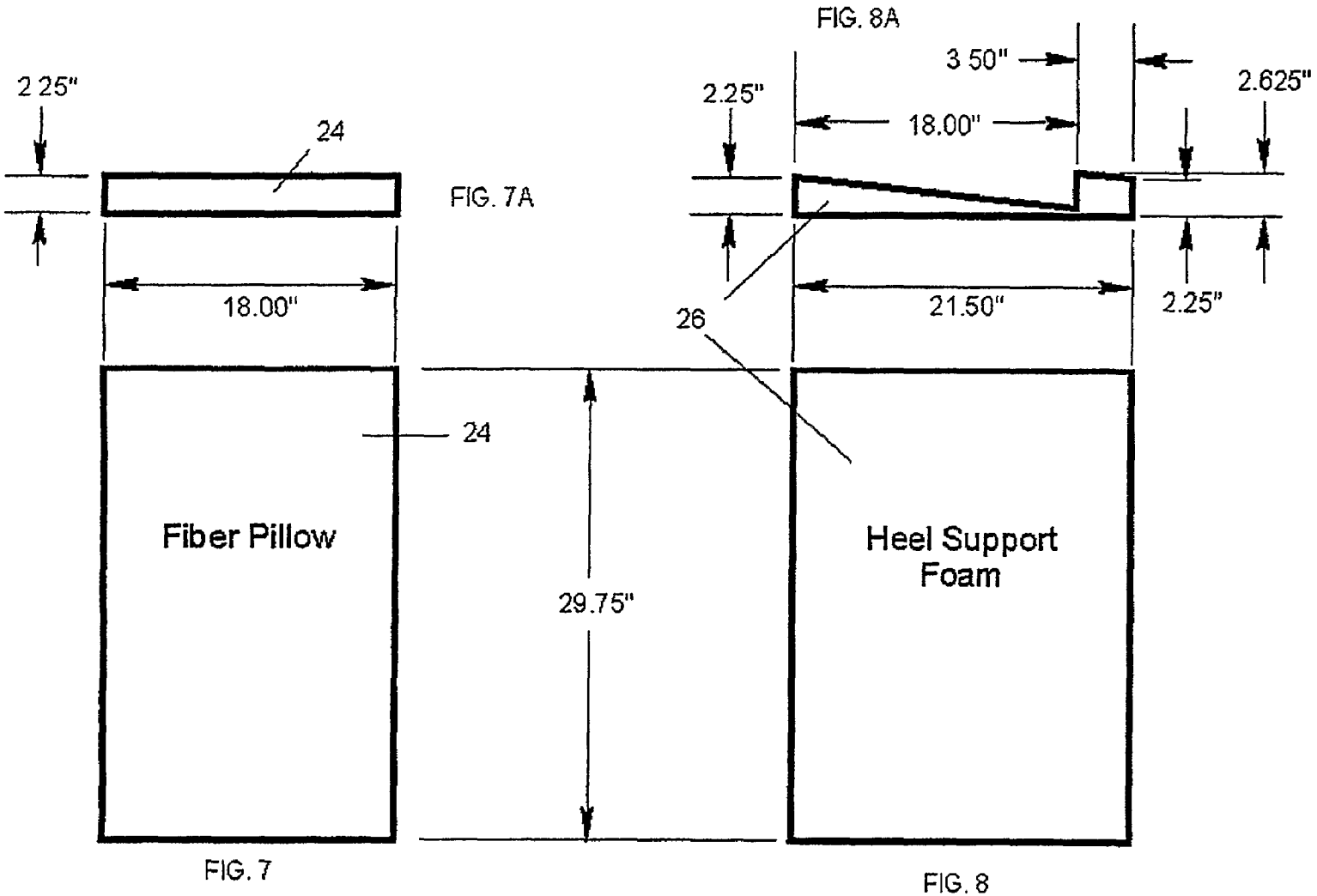
FIGS. 7 and 7A are top and side views, respectively, of a heel pillow showing its dimensions.
FIGS. 8 and 8A are top and side views, respectively, of a heel support showing its dimensions.
Figure 9A:
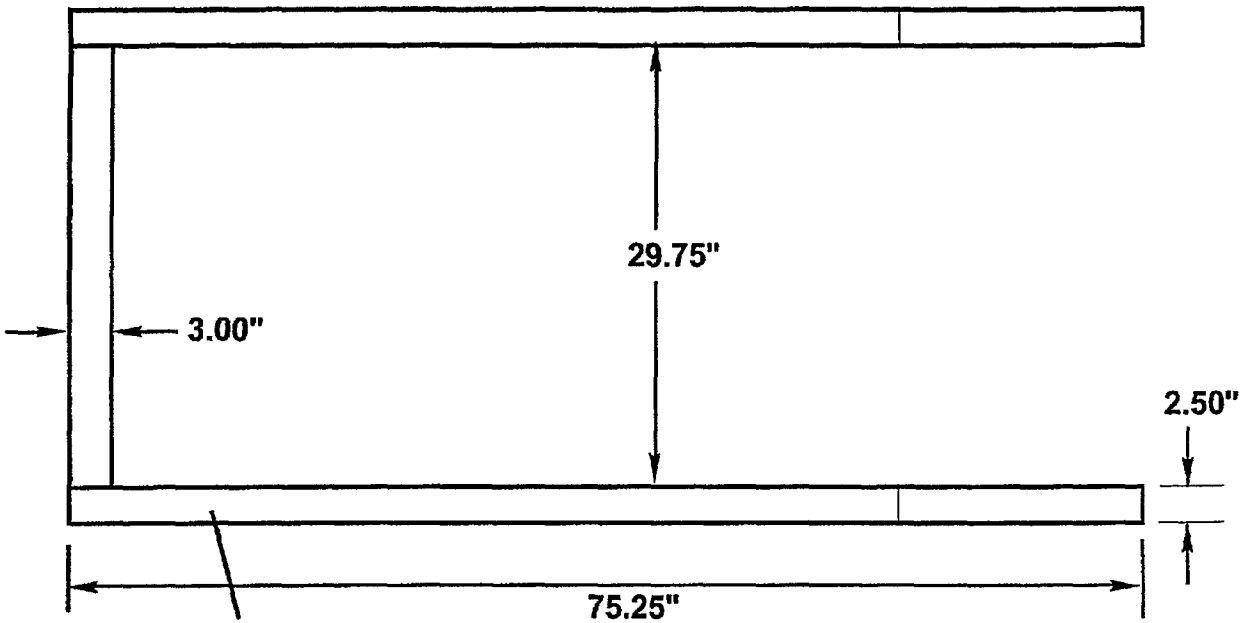
FIGS. 9 and 9A are side and top views, respectively, of a surrounding rail showing its dimensions.
Figure 9:
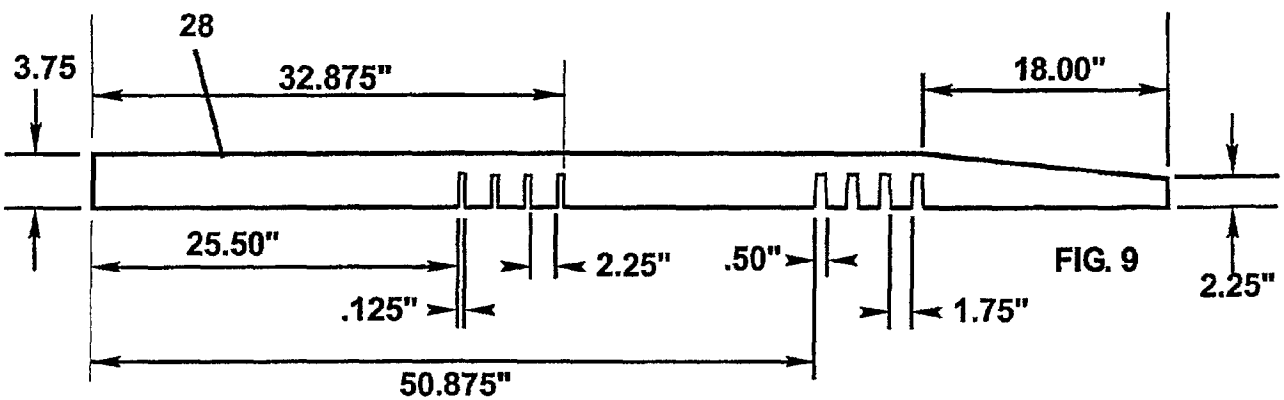
Figures 10, 10A, 10B:
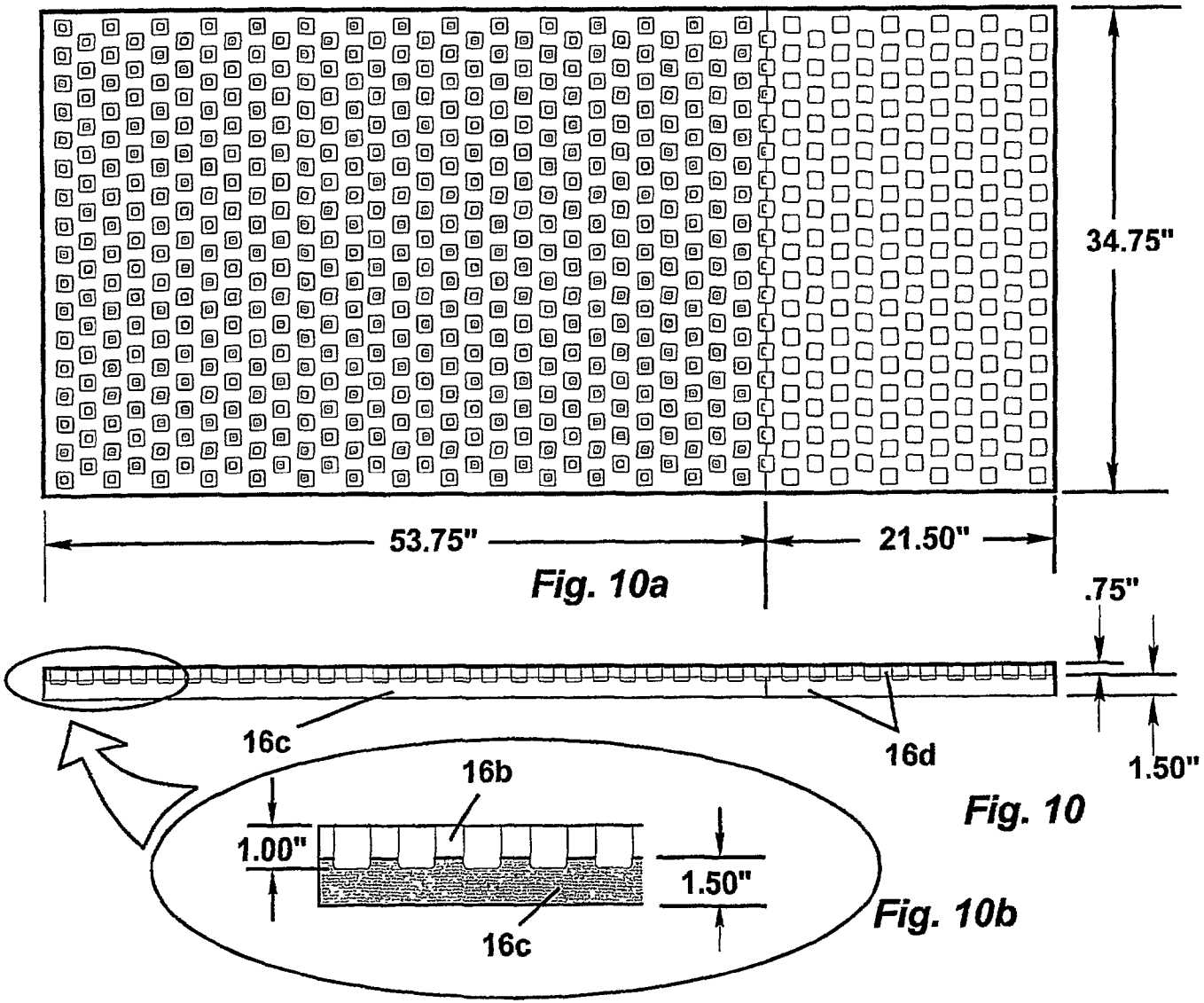
FIGS. 10 and 10A are side sectional and top views, respectively, of a top foam layer showing its construction and dimensions.
FIG. 10B is an enlarged side sectional view of the top foam layer shown in FIG. 10.
Figure 11:
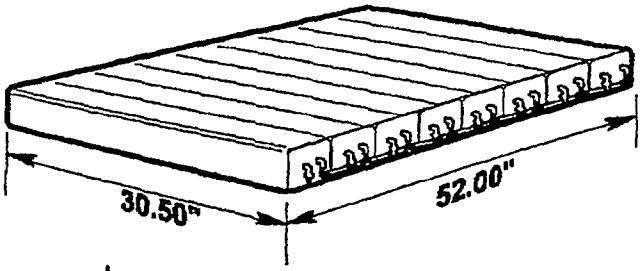
FIG. 11 is a top perspective view of the air segment showing the dimensions.
Figure 12:
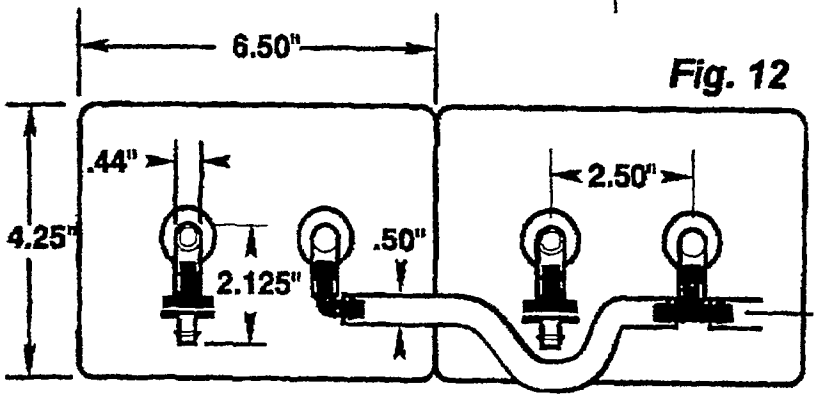
FIG. 12 is an end partial sectional view of the air cylinders of an air mattress showing the construction of the air inlets and outlets, their connections and dimensions.
Figure 12A:
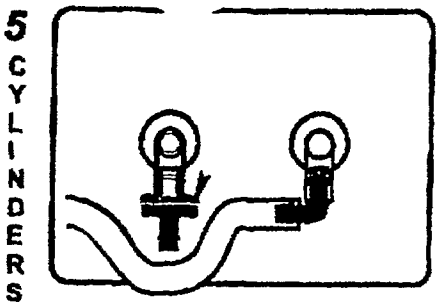
Figure 13:
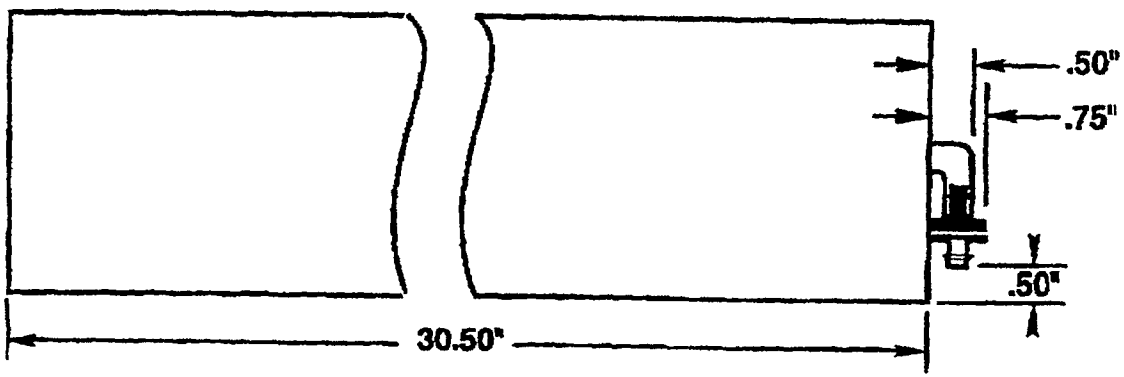
FIG. 13 is a side partial sectional view of the air cylinders of FIG. 12 showing the air inlets and the dimensions.

Further details of the various components described above are shown in FIGS. 7-11. FIGS. 7 and 7A are top and side views, respectively, of the fiber heel pillow 24 showing its dimensions. FIGS. 8 and 8A are top and side views, respectively, of the heel support 22 showing its dimensions. FIGS. 9 and 9A are side and top views, respectively, of the side/end rail 28 showing its dimensions. FIGS. 10 and 10A are side sectional and top views, respectively, of the first foam layer 16 showing its construction and dimensions, and FIG. 10B is an enlarged side sectional view of a portion of the first foam layer 16 shown in FIG. 10. FIG. 11 is a top perspective view of the air sector 18 showing its dimensions. FIG. 12 is an end partial sectional view of the air cylinders 18*a* showing the construction of the air inlets and outlets, their connections and dimensions. FIG. 13 is a side partial sectional view of the air cylinders of FIG. 12 showing the air inlets and the dimensions.

Referring back to FIG. 1, a bottom cover 32 is connected to the top cover 14 by suitable means such as a zipper. An upper layer of the bottom cover 32 is made of nylon laminated to a thin layer of butyl rubber. The lower cover is made of a four way stretchable low moisture vapor permeable polyurethane coated fabric. A zipper or other conventional means, such as hook and loop fabric connectors may also be used to connect the top cover 14 and the bottom cover 32.

Figures 4A, 4B, 4C, 4D:
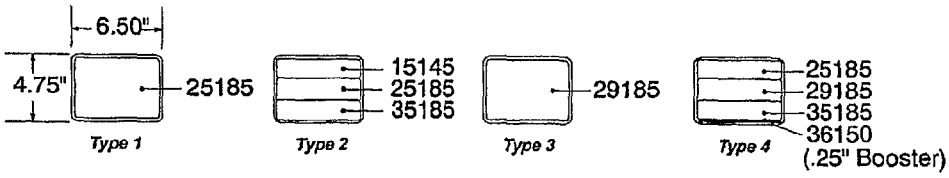
FIGS. 4A-D are side sectional views of various air cylinders.

The air cylinders 18*a* are described in more detail now. Referring to FIGS. 4A-D, the various constructions of the inner foam members of the air cylinders 18*a* are shown. In a preferred embodiment, each of the cylinders 18*a* is 6.50" wide and 4.75" high and has one of the four types of constructions shown in FIGS. 4A-D. The first two cylinders closest to the head of the mattress have a type 1 construction, which has a single piece of 25 IFD 1.85 lb/ft$^3$ foam as shown in FIG. 4A. The next cylinder from the head has a type 2 construction, consisting of three layers of foam (from the top, 15 IFD 1.45 lb/ft$^3$, 25 IFD 1.85 lb/ft$^3$, and 35 IFD 1.85 lb/ft$^3$ foam) as shown in FIG. 4B. The next three cylinders from the head have a type 4 construction with three layers of foam (from the top, 25 IFD 1.85 lb/ft$^3$, 29 IFD 1.85 lb/ft$^3$, and 35 IFD 1.85 lb/ft$^3$ foam) and a 0.25" booster layer of 36 IFD 1.50 lb/ft$^3$ foam below them, as shown in FIG. 4D. The next cylinder from the head has a type 3 construction with a single piece of 29 IFD 1.85 lb/ft$^3$ foam as shown in FIG. 4C. The last cylinder from the head, the closest to the foot end, has a type 2 construction shown in FIG. 4B. The arrangement of the four types of air cylinders is also illustrated in FIGS. 2 and 3. In all four types of air cylinders, a ¼ inch booster made of 46 IFD 1.80 lb/ft$^3$ foam is disposed at the bottom (not shown in FIGS. 4A-D). This provides a slight convexity to the mattress so as to counterbalance the initial impression made on the mattress by the patient.

The firmness and density of the foams filling the cylinders are varied according to the particular portion of the body it will support in order to minimize interface pressure focal points at the most vulnerable points, e.g. the scapular or sacral areas. The overall firmness of the types increases in the order of type 1 (softest), type 2, type 3, and type 4 (the firmest). The type 1 construction is used for the head, the type 2 construction is used for the scapular and heels, the type 3 construction is used for the thighs and the type 4 construction is used for the derriere.

The use of multiple layers of foam, rather than a single piece of foam helps to obtain the desired density and support characteristics. Although more expensive than using a single layer of foam material, this construction increases the performance of the mattresses.

Figure 5:
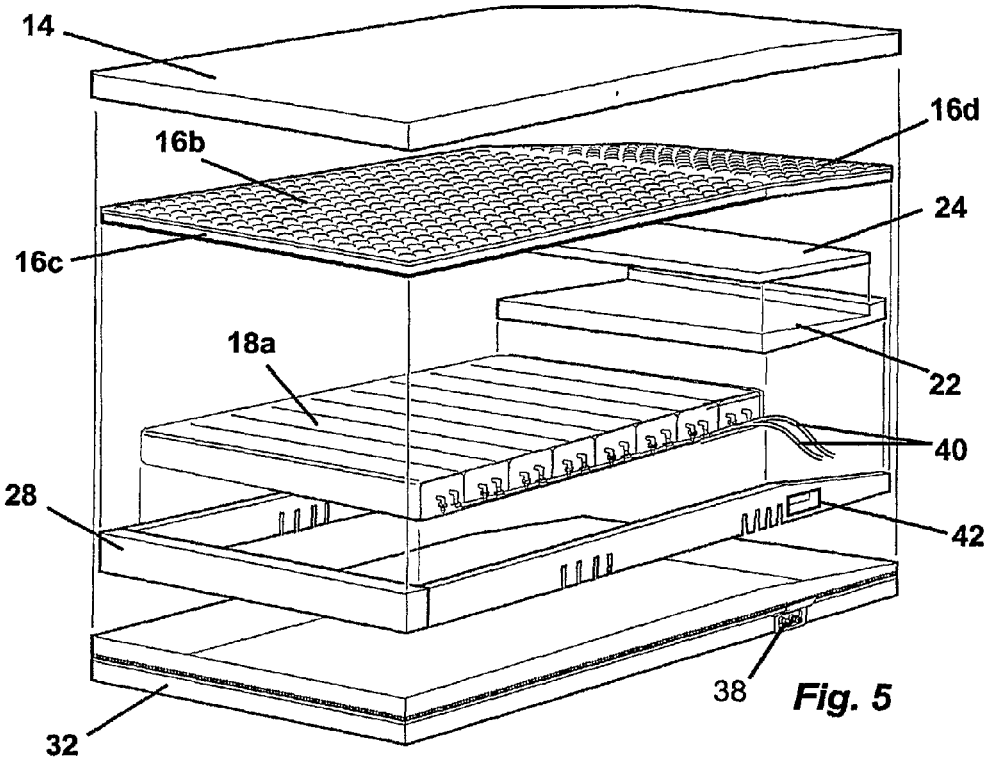
FIG. 5 is an exploded view of an air mattress according to an embodiment of the present invention.
Figure 6:
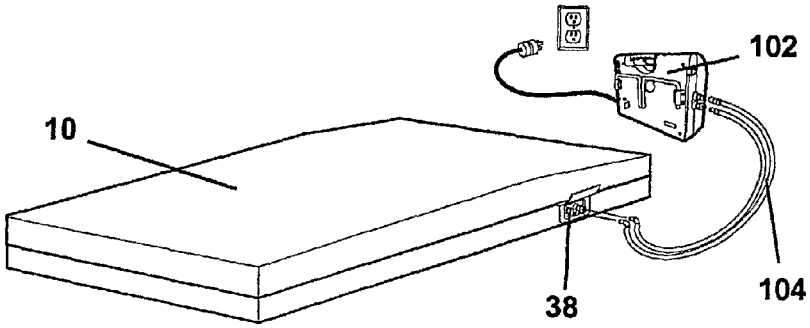
FIG. 6 illustrates the air mattress of FIG. 5 and a pump connected to the mattress.

Referring to FIGS. 2 and 3, side sectional views of two alternative mattresses are shown. The mattresses are similar except for the connections of the air outlets. The air cylinders 18*a* are filled with foam as described earlier, and have an air inlet 34 and an air outlet 36 on the end of each cylinder. The air inlets 34 are connected to the atmosphere through inlet valves 34*a*, and the air outlets 36 are connected together in various two different ways. In the example shown in FIGS. 2, 2A and 2B, the outlets 36 of all air cylinders 18*a* are connected together in series and connected to a single restricted internal check outlet valve 36*a*. This connection is used for non-powered air mattresses. In the example shown in FIGS. 3, 3A and 3B, the outlets 36 of alternating air cylinders 18*a* are connected together, and the two sets (four each) of outlets are connected to two hose connectors 38 on the side of the mattress 10 which may be connected to a pump. FIG. 5 is an exploded view of an air mattress 10 of FIG. 3 more clearly showing the two connectors 38 connected to the outlets 36 of the air cylinders via two tubes 40. A cutout 42 on the side rail 28 allows the tubes 40 to pass through. The remaining components of the air mattress in FIG. 5 are identical to those shown in FIG. 1. FIG. 6 shows the connectors 38 being connected to a pump 102 via two air hoses 104. The air cylinder connection pattern shown in FIGS. 3, 3A, 3B and 5 can be used in a powered or a non-powered air mattress. In particular, such an air mattress is convertible between a powered and a non-powered air mattress depending on whether a pump is connected. When a pump is not connected (i.e. non-powered use), restricted internal check valves similar to valve 36*a* are used for the two sets of outlets to allow slow, restricted outflow of air.

In a non-powered air mattress (for both the embodiment shown in FIGS. 2, 2A, 2B and the one in FIGS. 3, 3A, 3B when not powered), upon ingress, the pressure level changes in each affected air cylinder. When the pressure inside the cylinders reaches a higher than clinically effective internal level, the output valve releases air to achieve a therapeutic, low-pressure balance. This restricted outflow of air from the cylinders, in a non-powered situation, allows the patient to slowly settle into the supportive foam layers for optimal interface pressure distribution. The air cylinders re-inflate when the patient adjusts position or is vacated from the surface. The valve system allows for these pressure changes to occur slowly to minimize patient disorientation. The result is a support surface that achieves low interface pressures without the need for pumps or blowers.

Figure 3A:
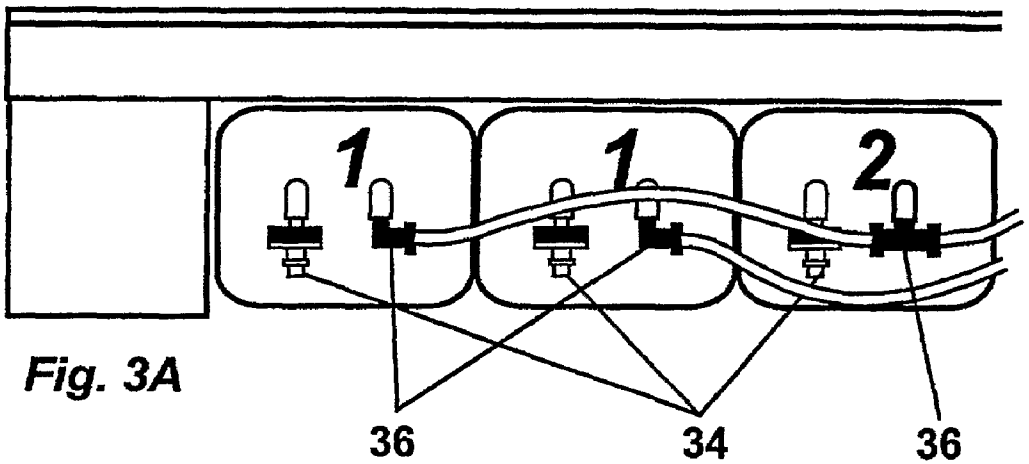
FIGS. 3A and 3B are enlarged views showing the air inlet/outlet connections of the air mattress shown in FIG. 3.
Figure 3B:
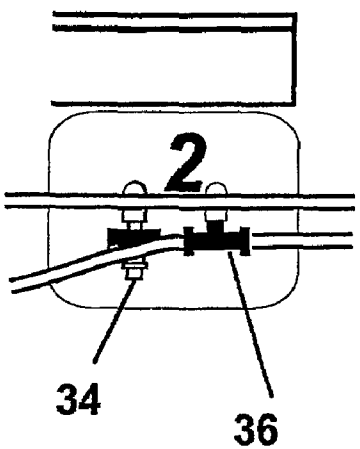
Figure 3:
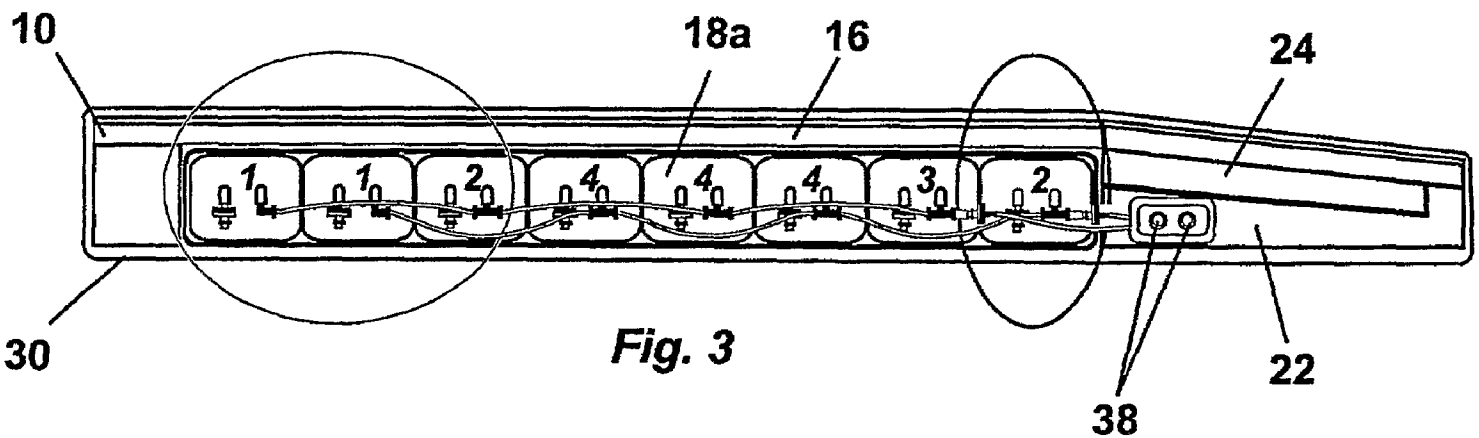
FIG. 3 is a side sectional view of an air mattress according to an embodiment of the present invention.

In a powered air mattress as shown in FIGS. 3, 3A and 3B, the two connectors 38 on the outside edge of the mattress 10 allow connection of an air pump to actuate the alternating pressure capability. When the air mattress is connected to the pump as shown in FIG. 6, the mattress can operate in an alternating pressure cycle. This is achieved by a rotary valve in the pump 102 which rotates at a predetermined cycle, and alternately lines up with one of the two air hoses 104 to pressurize one set of air cylinders 18*a* while allowing air to evacuate out through the pump from the other, previously pressurized set of air cylinders. This operation offers the therapeutic benefits of a gentle, alternating low pressure.

It is recognized that the number of air cylinders can be changed so that there are more or fewer than eight cylinders. Also, the precise foam densities used in the various components can be changed without departing from the present invention. The dimensions of the air cylinders are a matter of choice, but the preferred sizes are shown in FIGS. 4A-D. The overall dimensions of the mattress are also a matter of choice, but the preferred dimensions for mattresses sold for the United States market are approximately 80 inches×35 inches×7 inches and for most foreign markets 75.25 inches×29.75 inches×6.00 inches.

Also, the present invention has been described in the preferred embodiment as for an air powered system, the configuration of the foam can be used in a non air powered mattress or in a completely foam mattress. The present invention has been described in considerable detail in order to comply with the patent laws by providing full public disclosure of at least one of its forms. However, such detailed description is not intended in any way to limit the broad features, principles or scope of the present invention. It is intended that the present invention cover modifications and variations that come within the scope of the appended claims and their equivalents.

What is claimed is:

1. An air mattress comprising:

a plurality of layers of foam; and eight air cylinders disposed below the plurality of layers of foam, at least one air cylinder being filled with 25 IFD 1.85 lb/ft$^3$ foam, at least one air cylinder being filled with three layers of 15 IFD 1.45 lb/ft$^3$, 25 IFD 1.85 lb/ft$^3$ and 35 IFD 1.85 lb/ft$^3$ foam, at least one air cylinder being filled with 29 IFD 1.85 lb/ft$^3$ foam, and at least one air cylinder being filled with three layers of 25 IFD 1.85 lb/ft$^3$, 29 IFD 1.85 lb/ft$^3$ and 35 IFD 1.85 lb/ft$^3$ foam and a booster layer of 36 IFD 1.50 lb/ft$^3$ foam.

2. An air mattress comprising:

a plurality of air cylinders forming an air sector, at least some of the air cylinders being filled with different density resilient foam;

a heel support assembly disposed adjacent the air sector, the heel support assembly including a heel support made of foam and a fiber filled heel pillow disposed on top of the heel support, wherein a lower surface of the heel support is located on a same plane as a lower surface of the plurality of air cylinders;

a U shaped rail made of foam surrounding the air sector and the heel support assembly; and at least one foam layer disposed above the air sector and the heel support assembly.

3. The air mattress of claim 2, wherein at least some of the air cylinders are each filled with two or more layers of different density resilient foam.

4. The air mattress of claim 2, wherein each air cylinder includes an air inlet connected to the atmosphere by an air inlet valve and an air outlet, the air outlets of all air cylinders being connected together and to a restricted internal check outlet valve.

5. The air mattress of claim 2, wherein each air cylinder includes an air inlet connected to the atmosphere by an air inlet valve and an air outlet, the air outlets of alternating air cylinders being connected together and to a restricted internal check outlet valve.

6. The air mattress of claim 2, wherein each air cylinder includes an air inlet connected to the atmosphere by an air inlet valve and an air outlet, the air outlets of alternating air cylinders being connected together and to a hose connector, the hose connectors being adapted for connecting to a pump.

* * * * *